United States Patent [19]

Turner et al.

[11] Patent Number: 4,910,887

[45] Date of Patent: Mar. 27, 1990

[54] BOATING SHOE

[75] Inventors: Stephen R. Turner, Marblehead, Mass.; Charles H. Poole, Durham; William R. Peterson, Epping; Kenton D. Geer, Exeter, all of N.H.

[73] Assignee: The Timberland Company, Hampton, N.H.

[21] Appl. No.: 229,221

[22] Filed: Aug. 5, 1988

[51] Int. Cl.[4] ..... A43B 5/04; A43B 3/00; A43B 5/08

[52] U.S. Cl. ..... 326/114; 36/3 R; 36/8.1; 36/83

[58] Field of Search ..... 36/81, 3 R, 3 B, 4, 36/83, 114, 113, 87

[56] References Cited

U.S. PATENT DOCUMENTS

| | | | |
|---|---|---|---|
| 80,934 | 8/1868 | Jeandron-Ferry | 36/3 B |
| 346,126 | 7/1886 | Lotstrom | 36/3 R |
| 1,390,929 | 9/1921 | Saudino | 36/3 R |
| 1,932,557 | 10/1933 | Meucci | 36/3 R |
| 2,098,412 | 11/1937 | Bovay | 326/3 R |
| 2,185,762 | 1/1940 | Cox | 36/8.1 |
| 2,757,461 | 8/1956 | Cartmell | 36/87 X |
| 3,029,823 | 4/1962 | Zerkowitz | 326/4 X |
| 4,378,641 | 4/1983 | Tarlow | 36/114 X |
| 4,599,810 | 7/1986 | Sacre | 36/83 X |
| 4,617,745 | 10/1986 | Batra | 36/3 B |

FOREIGN PATENT DOCUMENTS

| | | | |
|---|---|---|---|
| 2546382 | 11/1984 | France | 36/114 |
| 2555026 | 5/1985 | France | 36/114 |
| 2586906 | 3/1987 | France | 36/114 |

*Primary Examiner*—James Kee Chi

*Attorney, Agent, or Firm*—Darby & Darby

[57] ABSTRACT

A boating shoe, comprises an upper unit, a midsole and a high traction outsole attached to the bottom of said midsole. The upper unit includes a padded tongue made of a substantially nonabsorbent material and an inner lining having at least two plies. The outer ply adjacent the wearer's foot is made of a hydrophobic material and the inner ply is made of a hydrophilic material with good wicking characteristics. A bottom sock made of a fabric material through which water can flow freely is sewn to the bottom of the upper unit. The midsole is molded from a plastic material and includes forward and rear drainage cavities, each having a plurality of upstanding projections for supporting the wearer's foot. Drainage channels extend from each of the cavities through the midsole to its outer surface so that water flowing into the cavities of the midsole will be drained from the shoe.

8 Claims, 11 Drawing Sheets

BOATING SHOE

This invention relates to an athletic shoe intended to be used for boating.

Sneakers and other types of athletic shoes are commonly worn on boats, particularly sailboats, where good traction and foot support can be very important. Conventional sneakers and athletic shoes tend rapidly to become water saturated in use, making the shoe uncomfortable and, in some cases, reducing its utility.

The problems caused by water seepage arise with many types of footwear. Ordinarily, solutions to these problems involve attempts to waterproof the shoe, i.e. to prevent water from entering the shoe. This approach is of little practical value in the case of a boating shoe where very often water pours in from the top. In that case a waterproof construction would cause the shoe to retain the water, thus increasing the level of discomfort for the wearer. Open footwear, such as sandals and the like, do not retain water but also do not provide the level of support, foot protection and comfort very often required on boats, particularly sail boats.

OBJECTS OF THE INVENTION

The principle object of the invention is to provide an improved boating shoe.

A more specific object of the invention is to provide a boating shoe with excellent traction and support, and which is more comfortable for the wearer than conventional sneakers and athletic shoes.

A still further object of the invention is to provide a boating shoe construction which enables water entering the shoe to be rapidly drained therefrom.

SUMMARY OF THE INVENTION

Briefly, in accordance with the invention, a boating shoe comprises an upper unit, midsole, and outsole. The midsole includes a drainage system which causes water pouring or seeping into the shoe to be drained from the shoe. The outsole, which is beneath the midsole, is made of a material which provides a high level of traction. In the preferred embodiment, the upper unit includes an inner lining of a non-absorbent material and an adjacent lining of an absorbent or hydrophilic material which tends to draw water from the user's foot. The bottom of the upper unit includes a mesh like bottom sock which allows water to pass from the shoe into the midsole, where it is channeled through the drainage system out of the shoe.

Shoes manufactured in accordance with the invention are capable of keeping the wearer's feet relatively dry in an extremely wet environment. Moreover, they provide the characteristics of high quality athletic shoes, namely, support, insulation, durability and flexibility.

THE DRAWINGS

FIG. 13 A is a side elevational view of the valve.

DETAILED DESCRIPTION

Since the invention has been designed specifically for use on boats, the shoe is characterized as a "boating shoe." Obviously, this is not intended in any way to restrict the utility of the invention. A shoe made in accordance with the invention could be used for any purpose, although the special benefits of the invention are realized only in wet environments.

Figure 1:
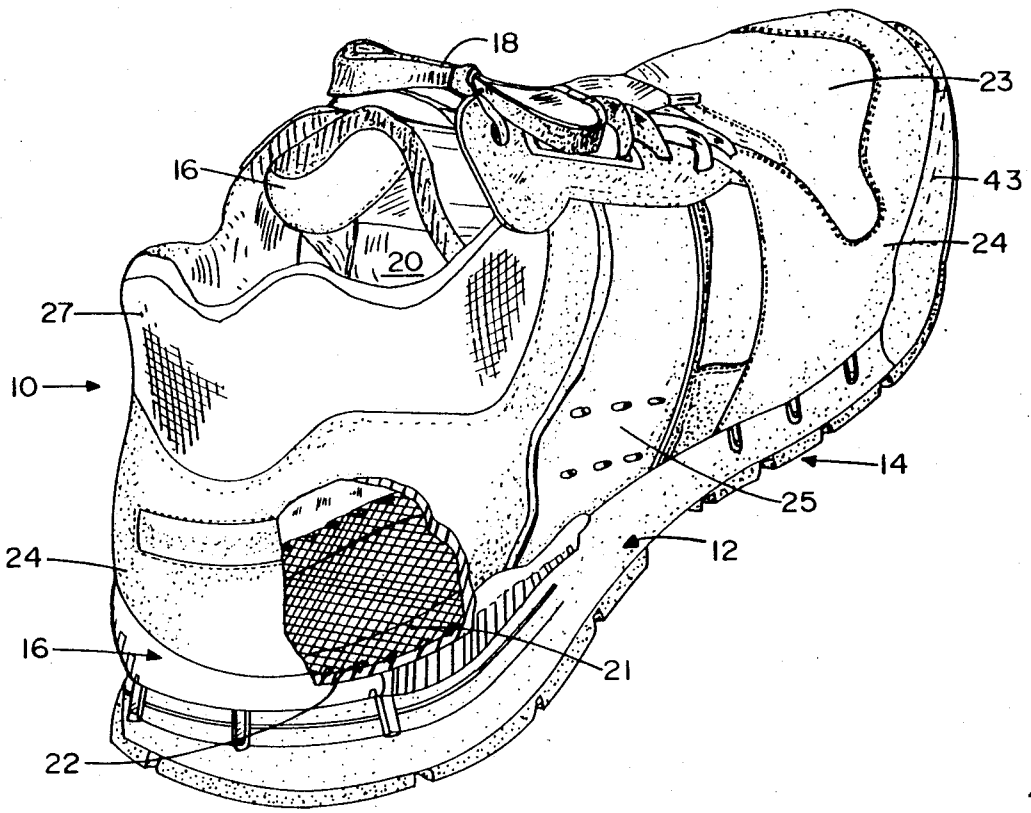
FIG. 1 is a perspective view of a boating shoe in accordance with a preferred embodiment of the invention.
Figure 2:
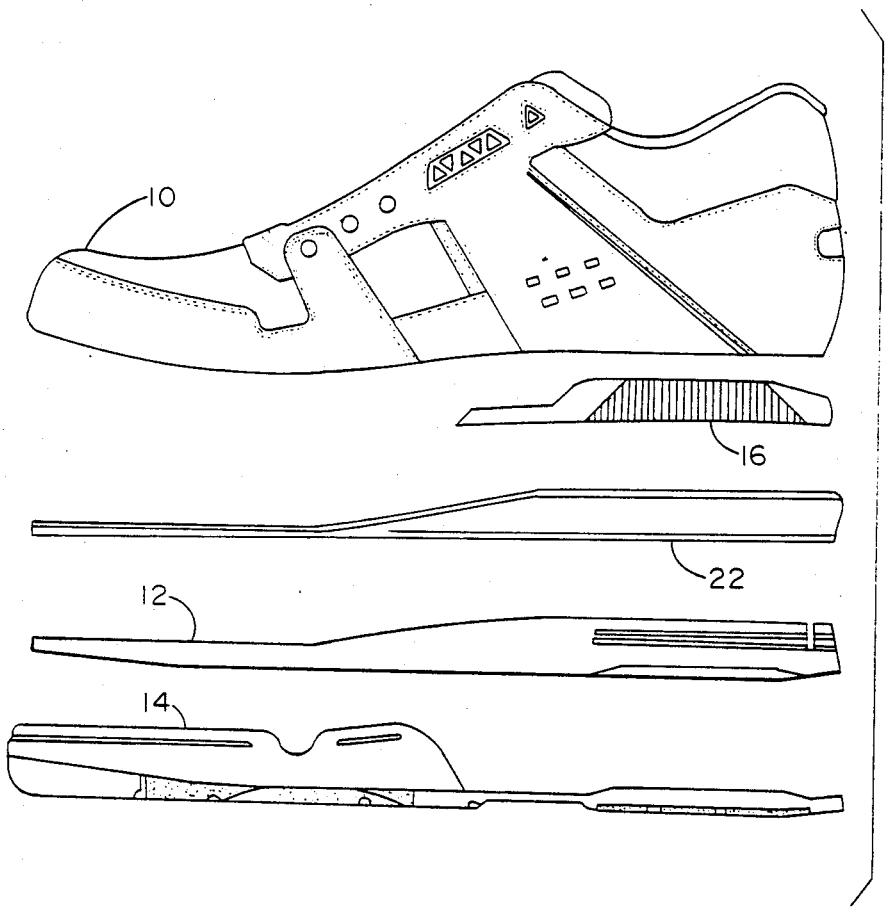
FIG. 2 is an exploded side elevational view showing the separate components of the shoe shown in FIG. 1.

Referring initially to FIGS. 1 and 2, a boating shoe according to a preferred embodiment of the invention comprises an upper unit 10, a midsole 12, and an outsole 14. A conventional stabilizer 16 also may be included as a separate part to provide support for the wearer's heel.

The upper unit 10 includes a tongue 16 and laces 18 to secure the shoe on the wearer's foot in conventional fashion. The upper unit is made in conventional fashion from materials commonly used in the footwear industry. It includes an inner lining 20 made of a material which is water repellent or hydrophobic so that the surface immediately adjacent the wearer's foot is relatively dry at all times. In the preferred embodiment of the invention, the inner lining 20 comprises a three-ply fabric consisting of a substrate, a hydrophilic material, and a hydrophobic material. One product which has been found useful for this purpose is a three-ply product sold by Faytex Corp. as its "2-Zone Comfort Lining" TM fabric. This fabric, which has the appearance of suede, conforms readily to the shape of the shoe. The outer layer, i.e. the layer adjacent the wearer's foot, is made of a hydrophobic or water repellent material which tends to remain dry (e.g. polyester). The next layer is made of a material which is hydrophilic and has good vertical wicking and spontaneous uptake characteristics. Natural fibers (e.g. cotton) have these properties inherently. The "2-Zone Comfort Lining" fabric manufactured by Faytex Corp. uses a proprietary nylon product sold under the trademark HYDROFIL which has moisture transfer properties comparable to natural fibers. By removing and absorbing perspiration, this fabric tends to draw perspiration away from the wearer's foot. In a boat shoe, perspiration is a trivial moisture problem, but the fabric functions well in maintaining a relatively dry surface adjacent the wearer's foot while directing water by virtue of its wicking characteristics to the bottom of the shoe where it can be disposed of through the drainage system described below.

Preferably, the tongue 16 is made of a molded relatively thick rubber such as neoprene. It may be lined on its inner (lower) surface with a fabric such as Faytex Corp.'s "2-Zone Comfort Lining" fabric. The tongue 16 is thick enough to provide a pad to protect the upper surface of the wearer's foot and may be covered on its outer (upper) surface with a material such as nylon that does not absorb water. The use of neoprene rubber for tongue 16 is particularly beneficial when the shoe is to be used with conventional "hiking straps", sometimes employed on boats for safety purposes, because of the additional buffering provided between the skin and the strap and also because the tongue does not become saturated with water.

A bottom sock 21 is sewn to the bottom of the upper unit 10. Bottom sock 21 comprises a flat mesh like fabric made of a material such as nylon which permits water to flow freely through the shoe into the drainage system within the midsole 12. For added comfort, a non-absorbent fabric may be sewn to the upper unit 10 beneath bottom sock 21. In the preferred embodiment of the invention, a removable inner sole or foot bed 22 may be placed on top of the bottom sock 21. The foot bed may be molded out of polyethylene to provide comfort and support, and includes a multiplicity of perforations (not shown) so that water can drain through the foot bed to the drainage system within the middle sole. The foot bed 22 may also be covered with a non-absorbent fabric to provide a dry feeling surface beneath the wearer's foot.

The construction of the upper unit 10 is generally that of a conventional athletic shoe and includes sections made of nylon mesh 23, leather or suede 24, and rubber 25 sewn on its outer surface. A soft padded fabric panel 27 extends around the shoe above the heel.

Figure 3:
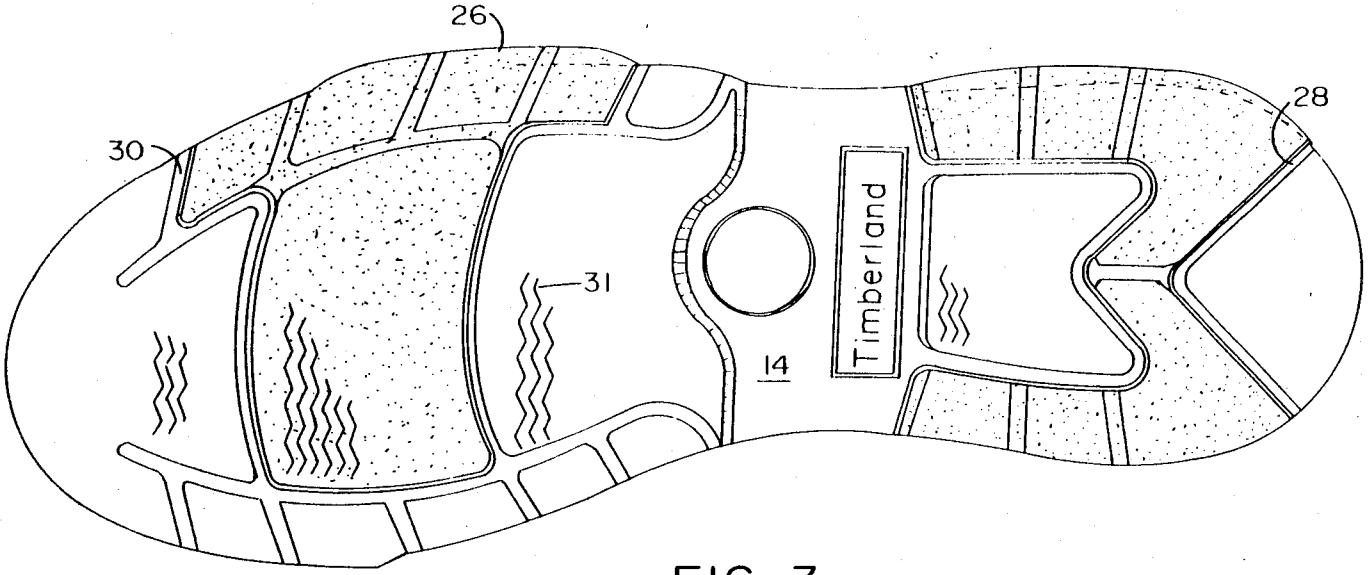
FIG. 3 is a bottom plan view of the shoe showing the bottom surface of the outsole.
Figure 4:
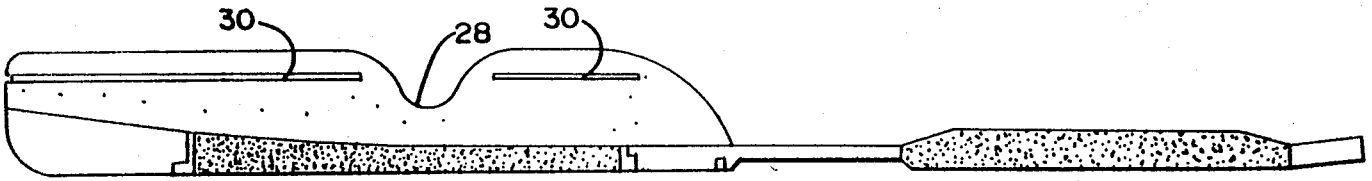
FIG. 4 is a side elevational view of the lateral side of the outsole.
Figure 5:
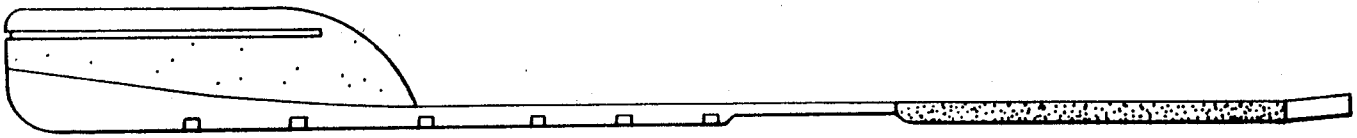
FIG. 5 is a side elevational view of the medial side of the outsole.
Figure 6:
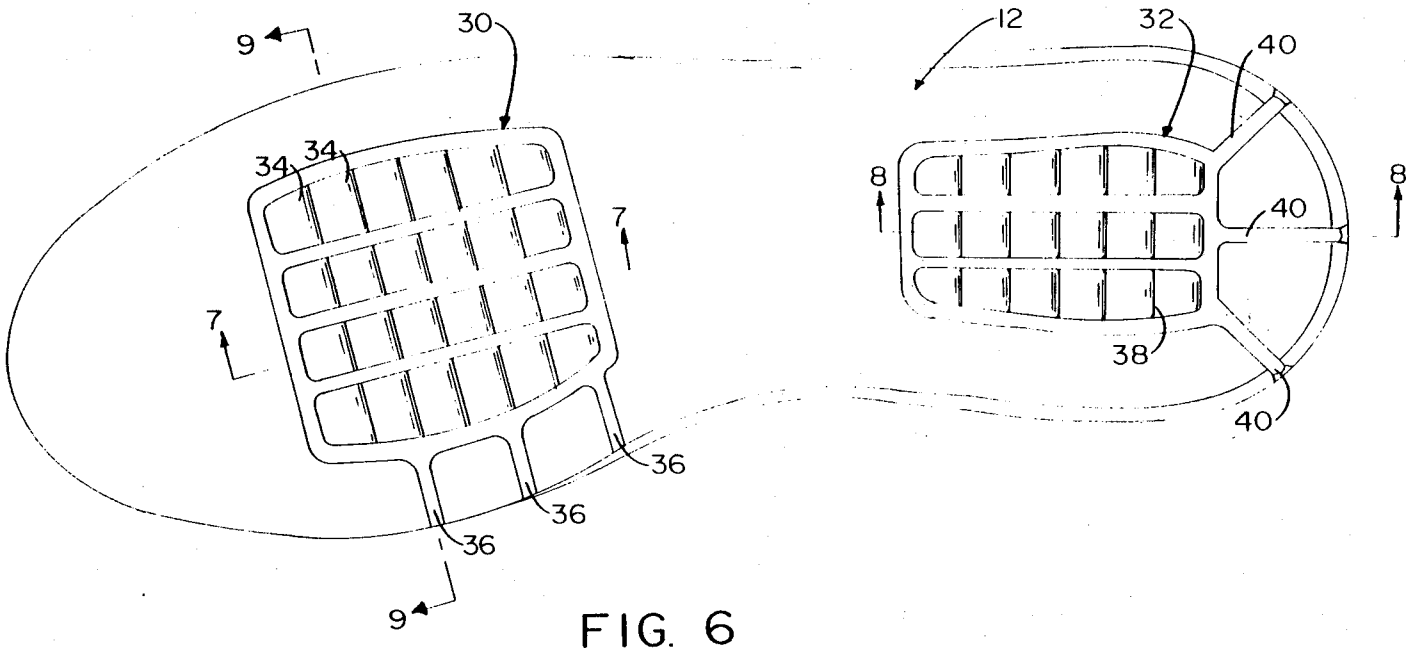
FIG. 6 is a top plan view of the midsole.

Details of the outsole 14 are shown in FIGS. 3, 4, and 5. The sole is made of two rubbers of different densities, the stippled portions in FIG. 3 representing a high traction rubber. Portions of the sole include siping which is represented by the wavy lines 31. Scuppers 30 on the edges of the sole help direct water from the underneath portion of the shoe. The outsole also includes a deep groove 28 in the forward portion of its lateral side to improve flexibility of the sole and stitch grooves 26 at the toe.

The principle features of the invention are contained within the midsole 12 which is shown in detail in FIGS. 6–9. Preferably, the midsole 12 is molded of a plastic material such as polyurethane and includes two somewhat rectangular depressed portions or cavities 33 and 32 at the forward and rear sections of the midsole 12, respectively. The cavity 33 is located approximately beneath the ball of the foot and the cavity 32 approximately beneath the heel. Four series of ramp-like projections 34 (see FIG. 7) extend lengthwise across the cavity 33, with the four series of ramps occupying most of the area of the cavity 33. The forward drainage system is completed by three open outlet channels extending from the cavity 30 out through the medial side of the midsole 12.

Figure 7:
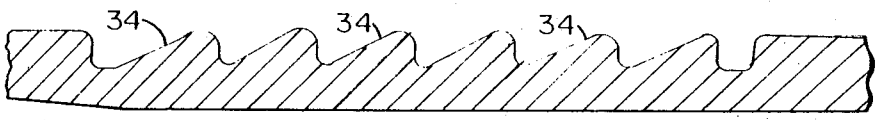
FIG. 7 is a sectional view along the line 7—7 of FIG. 6.
Figure 8:
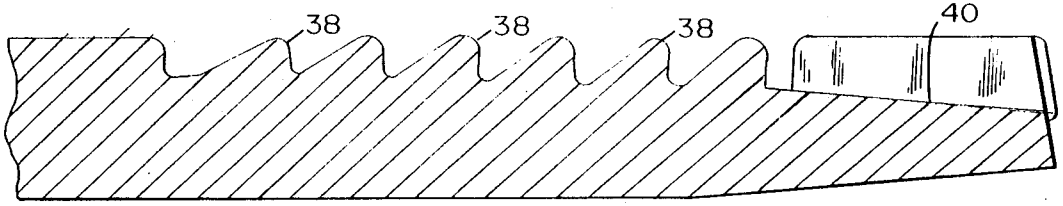
FIG. 8 is a sectional view along the line 8—8 of FIG. 6.
Figure 9:
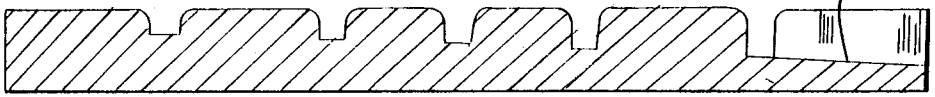
FIG. 9 is a sectional view along the line 9—9 of FIG. 6.

As shown in FIG. 7, the tops of the ramps rise to points which lie in the plane of the upper surface of the midsole 12. These ramps thus provide support for the wearer's foot in the area of the cavity. As shown in FIG. 9, the floor of cavity 33 slopes from the lateral side (at the top of FIG. 3) toward the medial side (at the bottom of FIG. 3) so that water which collects in the cavity 33 will tend to flow out of the channels 36 when the shoe is flat on a horizontal surface.

The rear drainage system is similar, comprising three series of ramp like projections 38 rising to a plane coplanar with the upper surface of the midsole 12 and three outlet channels 40 at the back of the shoe. In the case of the rear drainage system, the cavity 32 slopes from the front to the back (see FIG. 8) so that water will tend to flow out of the outlet channels 40 when the shoe is flat on a horizontal surface.

In use, water entering the shoe by pouring or seepage, flows through bottom sock 21 into the drainage systems 33 and 32 either directly or by virtue of the wicking action of the hydrophobic material within the lining 20. Once the shoe is removed from water, the water drains from channels 36 and 40 so that the shoe quickly loses its feeling of wetness.

The shoe can be manufactured by conventional shoe manufacturing processes which, therefore, are not described in detail. The polyurethane midsole 12 is attached by an epoxy adhesive to the rubber outsole 14. The stabilizer 16 is then attached by a urethane adhesive to the midsole. The upper unit 10 is then joined to the assembly by a combination of stitches 43 in the toe area and polyurethane cement.

Figure 10:
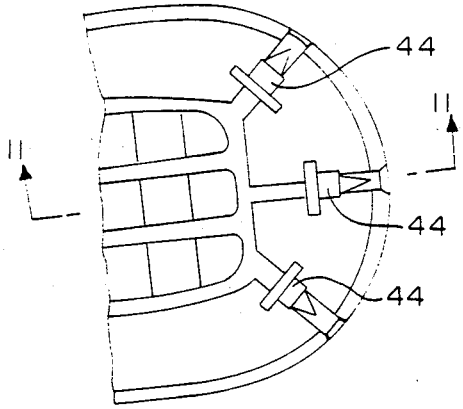
FIG. 10 is a partial top plan view of a midsole showing a second embodiment of the invention.
Figure 11:
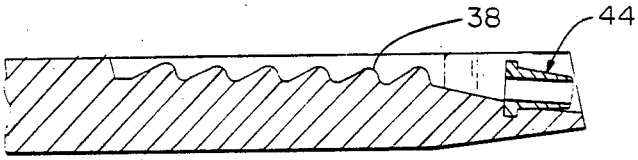
FIG. 11 is a sectional view along the line 11—11 of FIG. 10.
Figure 12:
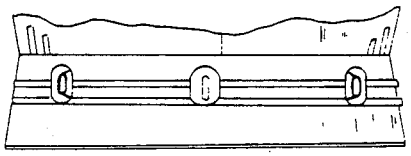
FIG. 12 is a partial rear elevational view of the shoe according to the second embodiment of the invention.
Figure 13:
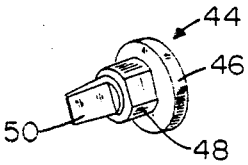
FIG. 13 is a perspective view of a valve construction used in the second, embodiment.
Figure 13A:
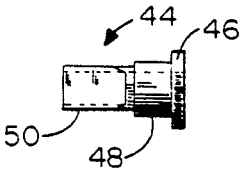
Figure 14:
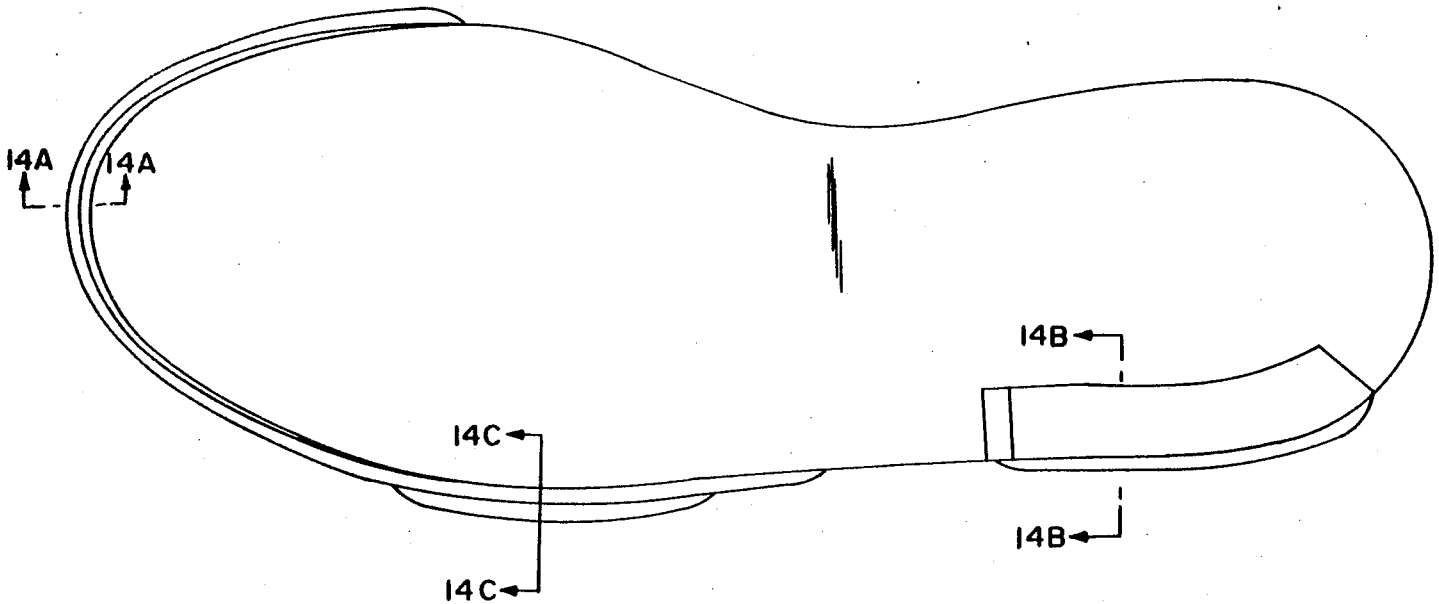
FIG. 14 is a top plan view of a preferred embodiment of the out sole.
Figure 14A:
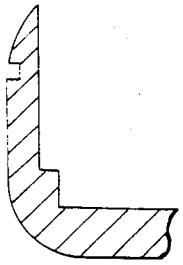
FIG. 14A is a partial sectional view along the line 14A—14A of FIG. 14.
Figure 14B:
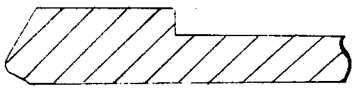
FIG. 14B is a partial sectional view along the line 14B—14B of FIG. 14.
Figure 14C:
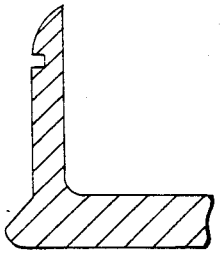
FIG. 14C is a partial sectional view along the line 14C—14C of FIG. 14.
Figure 15:
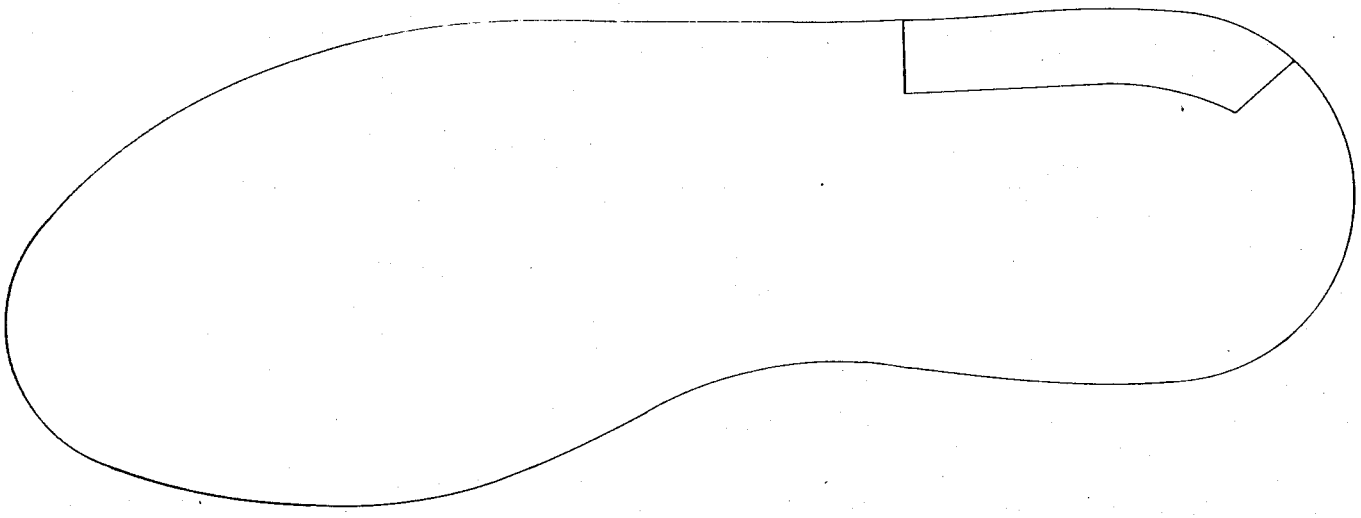
FIG. 15 is a bottom plan view of the mid sole.
Figure 16:
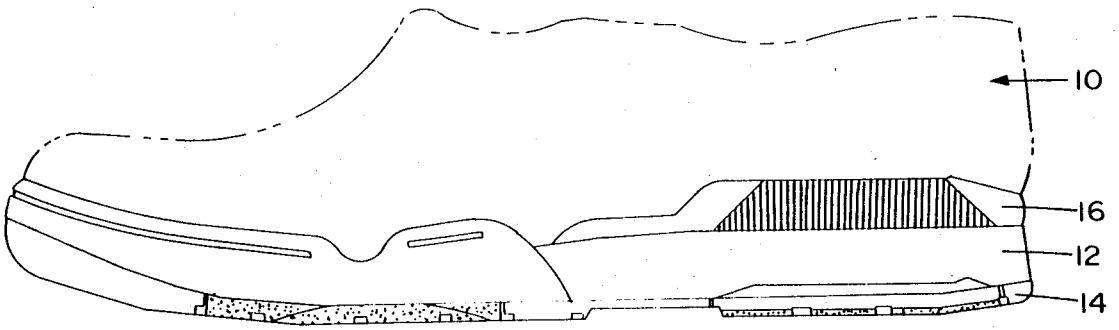
FIG. 16 is a side elevational view of the shoe shown in FIGS. 1–11, 14 and 15.

FIGS. 10–13 illustrate a second embodiment of the invention in which one way valves are introduced into the outlet channels 36 and 40. As shown in these drawings, the valves may comprise standard duck bill valves 44. These are commercially available devices made of rubber or plastic and include a flange 46, a cylindrical base 48 and a tapered rubber "duck bill" 50. The valves are inserted into the outlet ducts as shown in FIGS. 10–12 and are such that pressure exerted by the wearer's foot will cause water within the shoe to open the duck bill 50 so that the water can be expelled from the shoe. Water outside the shoe, however, cannot enter the closed duck bill 50 which, therefore, functions as a one way valve and prevents water from entering the shoe through the outlet ducts.

We claim:

1. A boating shoe, comprising:

an upper unit having an inner lining made of a hydrophobic material;

a midsole beneath said upper unit and including at least one cavity for draining water passing through said upper unit through the midsole and out of the shoe; and an outsole attached to the under surface of said midsole.

2. A boating shoe according to claim 1, wherein said cavity includes spaced apart upstanding projections for supporting the wearer's foot.

3. A boating shoe according to claim 2, wherein two cavities are provided, one in the forward portion of the midsole beneath the ball of the wearer's foot and the other in the rear portion of said midsole beneath the heel of the wearer's foot.

4. A boating shoe according to claim 3, wherein said forward cavity includes at least one channel for draining water from said forward cavity through the medial side of the shoe, and wherein said rear cavity includes at least one channel for draining water out of the rear of the shoe.

5. A boating shoe according to claim 4, wherein said projections are ramp shaped terminating at a point lying generally on a plane coterminous with the upper surface of the midsole.

6. A boating shoe, comprising an upper unit, a midsole and a high traction outsole attached to the bottom of said midsole;

said upper unit including a padded tongue made of a substantially nonabsorbent material, an inner lining having at least two plies, the outer ply adjacent the wearer's foot being a hydrophobic material and the inner ply comprising a hydrophilic material with good wicking characteristics, and a bottom sock made of a fabric material through which water can flow freely; and said midsole being molded from a plastic material and including forward and rear drainage cavities, each having a plurality of upstanding projections for supporting the portion of the wearer's foot adjacent said cavities, and at least one drainage channel extending from each of said cavities through said midsole to its outer surface so that water channeled into the cavities of said midsole will be drained from the shoe.

7. A boating shoe according to claim 6, wherein the drainage channel for said forward cavity drains through the medial side of the shoe, and the drainage channel for said rear cavity drains out of the rear of the shoe.

8. A boating shoe according to claim 7, wherein said projections are ramp shaped terminating at a point lying generally on a plane coterminous with the upper surface of the midsole.

* * * * *